United States Patent [19]

Jenkins

[11] Patent Number: 4,723,743

[45] Date of Patent: Feb. 9, 1988

[54] RACK FOR HOLDING PAPER AND PLASTIC GROCERY BAGS

[76] Inventor: Jeffrey C. Jenkins, 5221 University Ave., Madison, Wis. 53705

[21] Appl. No.: 56

[22] Filed: Jan. 2, 1987

[51] Int. Cl.[4] ..... A63B 55/04

[52] U.S. Cl. ..... 248/97; 220/19; 220/404; 248/99

[58] Field of Search ..... 248/95, 97, 98, 99, 248/100, 101; D6/566; 220/19, 401, 403, 404

[56] References Cited

U.S. PATENT DOCUMENTS

| | | | |
|---|---|---|---|
| D. 264,651 | 6/1982 | Adamson | D6/566 |
| D. 273,159 | 3/1984 | Adamson et al. | D6/566 |
| 1,895,904 | 1/1933 | Lutts et al. . | |
| 2,010,789 | 8/1935 | Roesel | 248/95 |
| 2,925,206 | 2/1960 | Hancock | 220/19 X |
| 2,964,211 | 12/1960 | Pfeffer | 220/19 |
| 2,994,441 | 8/1961 | Browning | 220/19 X |
| 3,186,667 | 6/1965 | Meuer | 248/97 |
| 3,334,766 | 8/1967 | Rogus | 220/19 |
| 3,349,942 | 10/1967 | Hitz | 220/401 X |
| 3,373,963 | 3/1968 | Snell | 248/97 |
| 3,861,125 | 1/1975 | Hagemeister | 248/99 X |
| 3,984,074 | 10/1976 | Forman et al. | 248/175 X |
| 4,031,689 | 6/1977 | Sullivan | 248/97 X |
| 4,199,122 | 4/1980 | Christie | 248/97 |
| 4,267,997 | 5/1981 | Meier | 248/97 |
| 4,372,512 | 2/1983 | Wolfe | 248/97 |
| 4,487,388 | 12/1984 | Provan | 248/97 |

*Primary Examiner*—Ramon O. Ramirez

*Attorney, Agent, or Firm*—Isaksen, Lathrop, Esch, Hart & Clark

[57] ABSTRACT

A rack which may be used for holding conventional paper grocery bags with foldable sidewalls or plastic bags having an open mouth and integral upwardly extendable handle loops located on opposite sides of the mouth, in an upright, open, supported position, the rack including a skeletal frame which has a pair of spaced side members, a back member, a bottom support member, and at least one front member where the members form a confinement boundary for the bag. The rack also includes an engagement rail at the top of each side member, where each engagement rail includes two inverted U-shaped portions which each have an outer arm, the two outer arms on each of the two side members for securely retaining one of the plastic bag handle loops so that the two pairs of outer arms on both side members support the suspended plastic bag and hold the mouth of the bag open. The engagement rail also includes a tab which is disposed substantially between the inverted U-shaped portions, the two tabs each being releasably engagable with a sidewall of a paper bag so that the tabs on both side members hold the paper bag open.

19 Claims, 4 Drawing Figures

RACK FOR HOLDING PAPER AND PLASTIC GROCERY BAGS

BACKGROUND OF THE INVENTION

1. Field of the Invention

The present invention relates to a rack which is adapted for supporting collapsible bags in an opened condition. More particularly, the invention relates to a rack which may be used for holding either conventional paper grocery bags or flexible plastic bags having integral handles thereon in an opened condition so that the supported bag may be loaded with trash or other articles.

2. Description of the Prior Art

Trash containers, whether they are garbage cans or waste baskets generally have imperforate walls and bottoms which often are substantial in weight or are formed with a substantial amount of raw material. Conventional paper grocery bags or plastic bags are often placed within these trash containers so that the trash may be removed from the container by simply removing the bag from the container. The walls and bottom of these collapsible bags are substantially capable of safely containing trash or other articles, therefore rendering the imperforate walls and bottoms of trash containers unnecessary. Since these paper and plastic bags are collapsible, however, some sort of structure is necessary for supporting the bags in an open position so that trash or other articles may be placed in the bag without having to manually hold the bag open.

Support racks have been designed which are capable of holding conventional paper grocery bags in an open position for receiving trash or other articles. One of these is designed to support the two inwardly foldable sidewalls of the conventional paper bag, but not the front or back walls thereof. Another of this type of support rack completely surrounds the paper bag on all four sides.

There currently is a trend in retail food outlets to pack articles into plastic bags having integral handle loops. Support racks have been designed for suspending a plastic bag in opened condition within the rack. This type of rack generally has some means at the top of the rack for engaging the integral handles of the plastic bag in such a manner that the mouth of the bag is held open so that articles may be placed within the suspended plastic bag. Usually this support rack provides support to the formless plastic bag at its two sidewalls, back wall and bottom, but not at the front wall of the bag. The front portion of these racks are often left completely open so that a user may remove the plastic bag from the rack without having to clear the top portions of the rack. Generally these types of support racks are used in retail supermarkets for packaging merchandise such as groceries. Typically, the bag is suspended within the rack for only a short time while the bag is being filled with merchandise, and therefore front wall support is unnecessary.

SUMMARY OF THE INVENTION

The present invention is summarized in that a rack which may be used for holding conventional paper grocery bags with inwardly folding sidewalls and plastic merchandise bags having an open mouth and integral upwardly extendable handle loops located on oppsite sides of that mouth, in an upright, open, supported position includes a skeletal frame which includes a pair of spaced side members, a back member, a bottom support member, and at least one front member, where the members form a confinement boundary for the bag therein. The rack for holding conventional paper grocery bags or plastic bags further includes an engagement rail at a top of each side member where each engagement rail includes two inverted U-shaped portions, each having an outer arm, the two outer arms on each of the two side members being used for securely retaining one of the plastic bag handle loops so that the two pairs of outer arms on both side members support the suspended plastic bag and hold the mouth of the bag open. The engagement rail at the top of each side member of the rack also includes a tab which is disposed substantially between the inverted U-shaped portions, the tabs each being releasably engagable with a sidewall of a conventional paper grocery bag so that the tabs on both side members hold the paper bag open.

The front members and the bottom support member of the rack may define an upwardly opening channel between the front members which allows a user's hand to support a bottom of the paper or plastic bag as the bag is lifted from the rack and placed outside the rack. Such an upwardly opening channel between the front members also would allow a nesting of one rack within another two racks by placing a first and second rack adjacent each other with their front members and upwardly opening channels facing each other respectively and then turning a third rack upside-down and placeing it within the first and second racks so that the back member of the third rack extends through the upwardly opening channels of the first and second racks, and one front member of each of the first and second racks extends through the channel of the third rack. The rack for holding conventional paper grocery bags and plastic bags in an upright, open, supported position may also include an unused bag holder which adjoins the back member of the frame and includes two opposing rectangular members which each have a centrally disposed opening and which can be used to receive and store unused folded bags therein.

A primary object of the invention is to provide a rack which may be used for holding conventional paper grocery bags and plastic bags having integral handle loops in an upright, open, supported position so the supported bag may be filled with trash or other articles.

Another object of the present invention is to provide a rack for supportively holding conventional paper grocery bags and plastic bags, having integral handle loops in an upright, open position, so that the rack provides support for the bag at all four bag walls and at the bottom of the bag.

An additional object of the present invention is to provide a rack for supportively holding conventional paper grocery bags and plastic bags having integral handle loops, the rack having an upwardly opening channel defined by the front members and the bottom support member which allows the user's hand to support a bottom of any bag as the bag is removed from the rack and placed outside the rack.

A further object of the present invention is to provide a rack which supportively holds conventional grocery bags or plastic bags having handle loops in an upright, open position, where one of the racks can be nested within two identical racks for more efficient utilization of space in storage, or transportation.

Yet another object of the present invention is to provide a rack for supportively holding conventional paper grocery bags, or plastic bags having integral handle loops where the rack also has a means for storing folded, unused bags.

Other objects, features, and advantages of the invention will be apparent from the following detailed description taken in conjunction with the accompanying drawings wherein a preferred embodiment of the invention has been selected for exemplification.

DESCRIPTION OF THE PREFERRED EMBODIMENT

Figure 1:
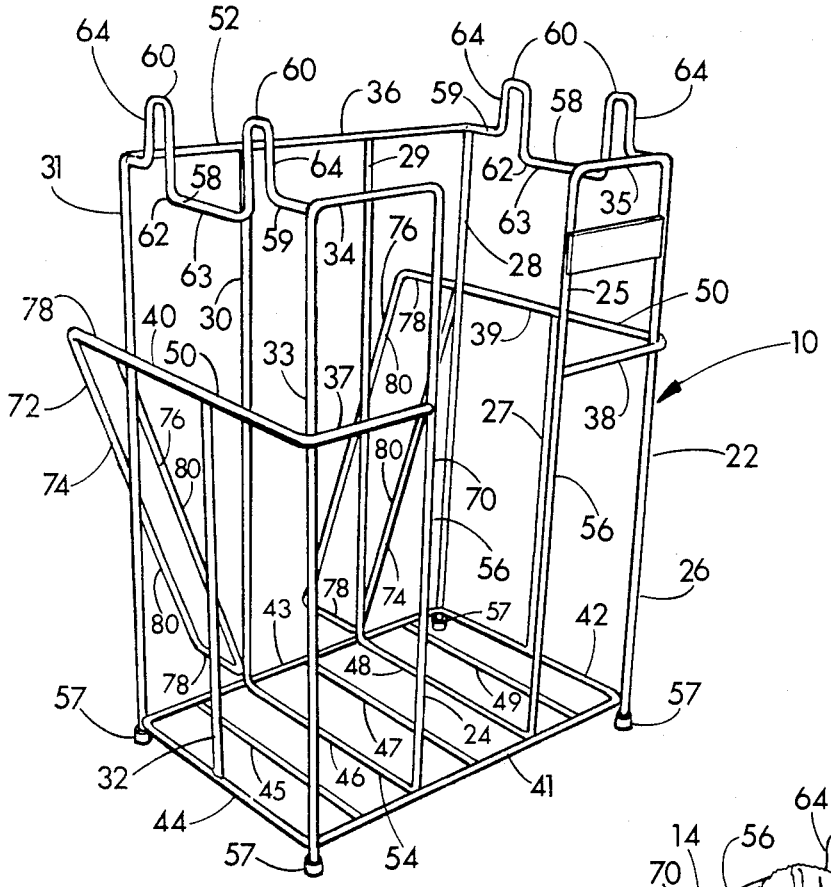
FIG. 1 is a perspective view of a rack in accordance with the invention for supportively holding paper and plastic grocery bags.
Figure 2:
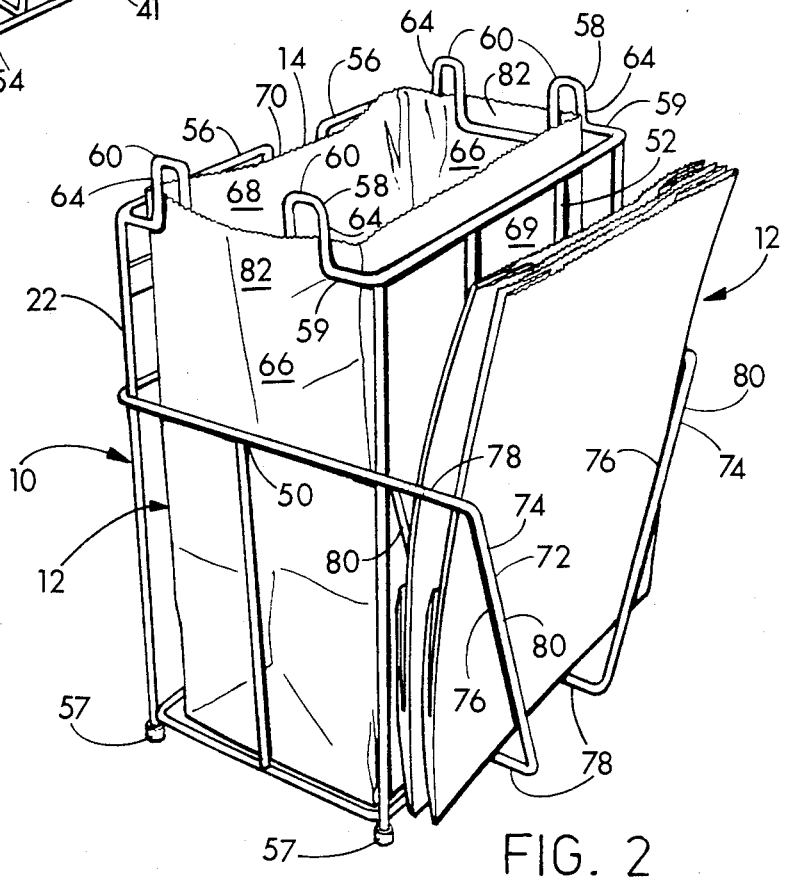
FIG. 2 is a perspective view thereof showing the rear and left side of the rack with a paper grocery bag held within the rack and folded paper bags in the unused bag holder.
Figure 3:
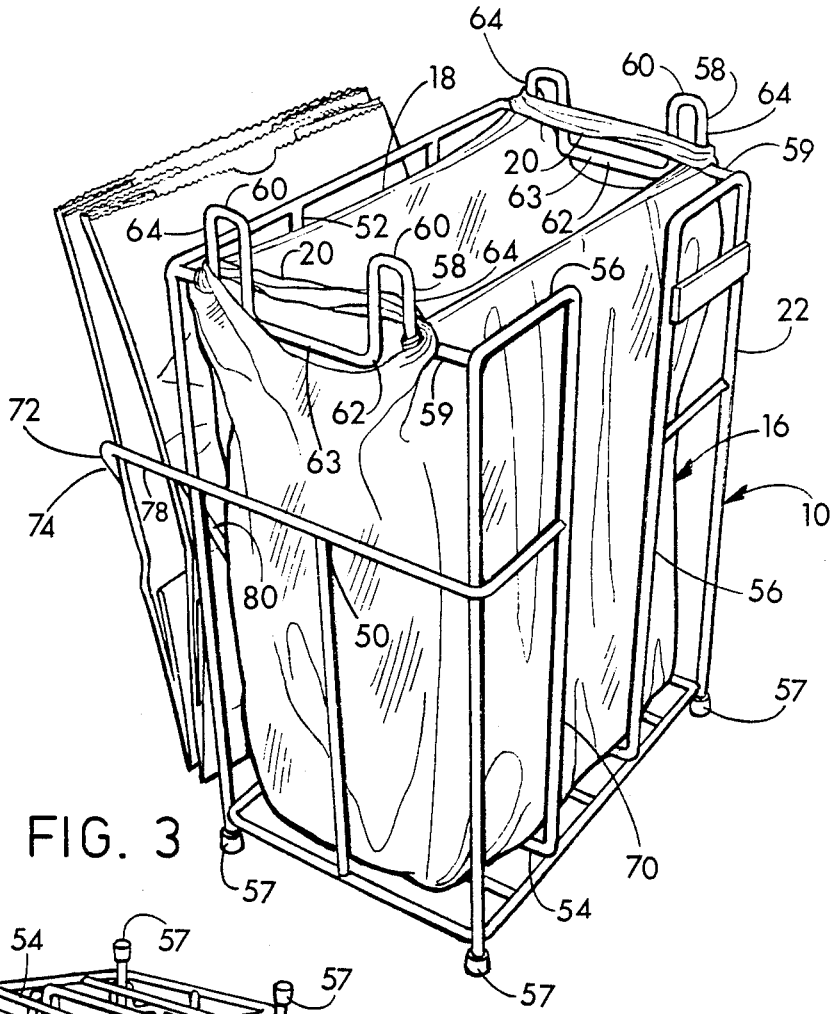
FIG. 3 is a perspective view thereof with a plastic bag having integral handle loops supportively held within the rack.

Referring more particularly to the drawings, wherein like numbers refer to like parts, FIG. 1 shows a rack 10 for holding a paper or plastic grocery bag in a upright, open position so that trash or other articles may be placed within the bag. FIG. 2 shows the rack 10 supportively holding a conventional paper frocery bag 12 with the mouth 14 of the bag 12 held open. FIG. 3 shows the rack 10 supportively holding a plastic bag 16 which has an open mouth 18 and two integral upwardly extendable handle loops 20 which are located on opposite sides of the mouth 18. As shown in FIG. 1, the preferred rack 10 includes a skeletal frame 22 which is formed from a plurality of vertical rod portions 24, 25, 26, 27, 28, 29, 30, 31, 32 and 33 and a plurality of horizontal rod portions 34, 35, 36, 37, 38, 39, 40, 41, 42, 43, 44, 45, 46, 47, 48 and 49 which are joined together to form a pair of spaced mirror-imaged side members 50, a back member 52, a bottom support member 54, and two front members 56. The members 50, 52, 54, and 56 join together to form a confinement boundary for the bag which is supportively held by the rack therein. The bottom ends of vertical rod portions 26, 28, 31 and 33 preferably extend below the bottom support member 54 to provide four feet 57 upon which the rack 10 sits. The feet 57 preferably each include a resilient cap, as shown, which prevents marring of a supporting surface. In the preferred rack 10, the rods which include the horizontal and vertical rod portions are welded together at their junctures to form the rigid, skeletal frame 22.

The rack 10 also includes two engagement rails 58, each of which is located at a top 59 of each side member 50. Each of the two engagement rails 58 includes two inverted U-shaped portions 60 and a tab 62 which is substantially disposed between the inverted U-shaped portions on the engagement rails 58. Each inverted U-shaped portion 60 includes an outer arm 64, there being a total of four outer arms 64 on the rack 10. Each pair of outer arms 64 which is located on one engagement rail 58 is used for securely retaining one of the plastic bag handle loops 20. Both pairs of outer arms 64 on the two engagement rails 58 therefore will securely retain both of the plastic bag handle loops 20 so that the suspended plastic bag is held by means of the outer arms 64 and handle loops 20 with the mouth 18 of the bag 16 held open as shown in FIG. 3. The plastic bag 16 should hang down into the rack 10 within the confinement boundary formed by the members 50, 52, 54, and 56.

The tab 62 is disposed substantially between the inverted U-shaped portions on each of the two engagement rails 58 and extends downwardly from the inverted U-shaped portions. Each of the two tabs 62 are designed so as to be releasably engageable with a sidewall 66 of a conventional paper grocery bag 12 which is placed inside the rack 10 as shown in FIG. 2. A common conventional paper grocery bag 12 generally has sidewalls 66 which are about seventeen inches in height. Therefore a rack 10 designed to support such a grocery bag 12 should be sized such that the bottom portions 63 of the tabs 62 are less than seventeen inches above the bottom support member 54 to extend below and retain the sidewalls of the grocery bag in the manner shown in FIG. 2.

The engagement rails 58 in the preferred rack 10 form the top 59 of each side member 50 and extend between a front member 56 and the back member 52. In the preferred rack 10 the two engagement rails 58, including the two inverted U-shaped portions 60 and tab 62 on each rail 58, and also the horizontal rod portion 36 which tops the back member 52 are all formed from a single metal rod. In the preferred rack 10 horizontal rod portions 34, 35 and 36 which form the top borders of the two front members 56 and back member 52 are located less than seventeen inches above the bottom support member 54 so that the front wall 68 and back wall 69 of a common conventional paper grocery bag which is placed within the rack 10 and supported by the bottom support member 54, extend slightly above horizontal rod portions 34, 35 and 36 such that these horizontal rod portions do not interfere with the front 68 or back 69 wall of the paper bag when it is removed from the rack 10 by a user.

A channel 70 extends between the two front members 56 and bottom support member 54 as best shown in FIG. 1. This channel 70 is defined by vertical rod portions 24 and 25 and horizontal rod portion 41. The channel 70 serves two purposes. First of all, the channel 70 allows a user to remove a paper bag 12 or plastic bag 16 from the rack 10 while using his hand to support the bottom of the bag 12 or 16. While the bag 12 or 16 is being lifted from the rack 10, no part of the rack 10 interferes with the upwardly moving user's hand which is supporting the bottom of the bag 12 or 16. Secondly, the channel 70 allows one rack 10 to be nested within two identical racks 10, as will be explained below.

Adjoining the back member 52 of the skeletal frame 22 is an unused bag holder 72 which is formed from two opposing rectangular members 74 which each have a centrally disposed opening 76 to receive unused folded bags 12 therein. Each rectangular member 74 is formed from a single rod which also includes the horizontal rod portion 39 or 40. A single rod is bent to preferably form the two sides 80, and to form the two ends 78 of each rectangular member 74. The uppermost end 78 of the rectangular members 74 in the preferred rack 10 is contiguous with the horizontal rod portion 39 or 40 as shown in FIG. 1. The ends 78 of the rectangular members 74 are oriented perpendicularly to the back member 52 of the rack and the sides 80 of the rectangular member 74 are oriented in parallel to the back member 52. Two sides 80 are preferred for strength and rigidity, although the sides 80 abutting the back member 52 could be omitted without impairing the function of the bag holder 72. The rectangular members 74 converge in a downward direction as shown in FIG. 2.

In its use, the rack 10 for holding paper and plastic bags of FIG. 1 is intended to be an apparatus which can hold either conventional paper grocery bags 12 with inwardly folding sidewalls 66 or plastic merchandise bags 16 having integral handle loops 20 in a supportive open position for receiving articles or trash therein. The user may take a conventional paper grocery bag 12, place his hand inside the bag 12 and push the side walls 66 outwardly so that the bag 12 is expanded to its full volume. The user then should place the bag 12 down into the rack 10 resting on the bottom support member 54. The top portion 82 of each sidewall 66 which is adjacent a tab 62 should be pulled down and under the tab 62, and then be allowed to come back up to the outside of the tab 62. The top portion 82 of the paper bag 12 sidewalls 66 will remain to the outside of the tabs 62. In this manner the bag 12 is held in an open configuration so that the full volume of the bag 12 may be utilized for placing articles or trash therein.

After the bag is substantially full of articles or trash, the user will want to remove the bag 12 from the rack 10. To do this, the user simply pulls the top portions 82 of the paper bag side walls 13 which are to the outside of the tabs 62 downwardly, then inwardly and then up to the inside of the tabs 62. The user then with one hand may grab the top of the bag 12 and with the other hand passing through the channel 70 may support the bottom of the bag 12, and thereby lift the bag 12 out from the rack 10 without any interference from the rack 10 to the hand which supports and lifts the bottom of the bag 12.

The user may also place a flexible plastic bag 16 in the rack 10. The two outer arms 64 which are located in each engagement rail 58 are designed to engage one of the integral upwardly extending handle loops 20 which are located on each side of the bag mouth 18. In this manner, the mouth 18 is held open, and the bag 16 is expanded to its full volume. A handle loop 20 may be placed around the two outer arms 64 on an engagement rail 58 in several ways while the bag 16 is placed in the rack 10. For example, a user may simply pull the handle loop 20 from the interior of the rack 10 over and around both of the inverted U-shaped portions 60 on an engagement rail 58. In this manner, the handle loop 20 would be held by each of the two outer arms 64 on the engagement rail 58. Or a user could first pull the handle loop 20 under the engagement rail 58 and then up, over and around the inverted U-shaped portions 60 from the exterior of the rack 10, as shown in FIG. 3. In either case, the handle loop 20 could again be pulled under the engagement rail 58 and pulled up and over the inverted U-shaped portions 60 to make the handle loop 20 more tightly bound to the inverted U-shaped portions 60. By engaging each of the two handle loops 20 on the outer arms 64 of the two engagement rails 58, the user will thereby suspend the plastic bag 16 within the rack 10 with its mouth 18 open. Each of the handle loops 20 may be removed from the outer arm 64 and engagement rail 58 by reversing the above suggested procedures for engaging a handle loop 20 to the outer arms 64. To remove the bag 16 from the rack 10, a user simply removes both handle loops 20 from their respective engagement rails 58, and then pulls the bag 16 up out of the rack 10 by the disengaged handle loops 20. If desired, the user may place his or her hand through the channel 70 to support the bottom of the plastic bag 16 while lifting the bag 16 out of the rack 10. The user will be able to support the bag 16 as it is lifted out of the rack 10 without any interference by the rack 10 to that hand. The design of the rack 10 for holding paper and plastic bags is also designed to permit the user to suspend and retain a plastic bag 16 within a conventional paper grocery bag 12 also placed in the rack 10, with both bags being removable separately or together by the same removal methods described herein.

Use of the unused bag holder 72 to store paper bags 12 is equally convenient. To do so, the user simply folds the paper bags 12 in a flat conventional manner, and then places them into the unused bag holder 72 as shown in FIG. 2.

Figure 4:
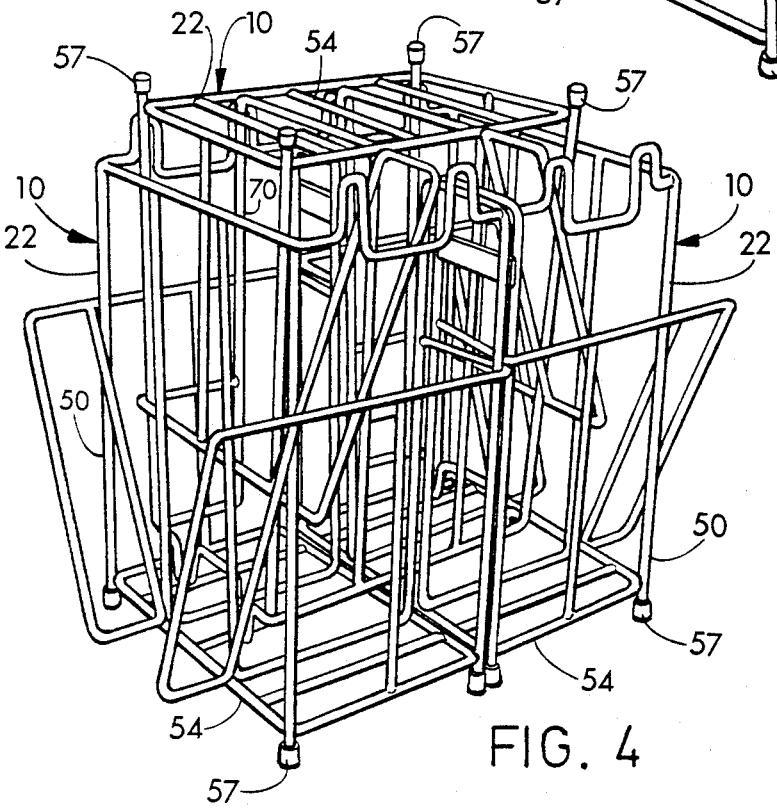
FIG. 4 is a perspective view showing one rack in accordance with the invention which is nested within two identical racks.

The rack 10 for holding paper and plastic bags is also designed so that one rack 10 may be nested within two other racks 10 to thereby decrease the volume required for storage or transportation of the racks 10, as shown in FIG. 4. To do this, a user should first place a first rack 10 and a second rack 10 in adjacent relation with the front members 56 and channel 70 of the first rack 10 facing and abutting the front members 56 and channel 70 respectively of the second rack 10. The user them may take a third rack 10, turn it upside-down over the other two racks 10, and lower the third rack 10 so as to place it within the first and second racks 10. This nesting may be done so that the back member 52 of the third rack 10 extends through the adjacent channels 70 of the first and second racks 10, and so that one front member 56 of each of the first and second racks 10 extends through the channel 70 of the third rack 10. Also, one rack 10 may be partially nested within another two racks 10 in at least one alternative fashion. For example, a first and second rack 10 could be placed adjacent to each other with one side member 50 of each facing each other, and the front members 56 of both racks 10 facing in the same direction. A third rack 10 then may be turned upside-down over the other two and lowered so as to be placed partially within the other two racks 10. One side member 50 each of the first and second racks 10 would then lie within the channel 70 of the third rack 10, and the side members 50 of the third rack 10 would extend through the channels 70 of the first and second racks 10.

The rack for holding paper and plastic bags eliminates the need for having two different types of racks when it is desired to be able to utilize both types of bags for collecting waste or other articles. Additionally, the rack 10 provides its own means for storing unused paper bags. The rack 10 provides support to any bag which is placed within the rack 10 on all four walls of that bag, yet there is no interference to a user's hand when he or she uses that hand to support and lift the bottom of a bag when the bag is being removed from the rack 10.

It is to be understood that the present invention is not limited to the particular arrangement and embodiments of parts disclosed and illustrated herein, nor to the material specified, but embraces all such modified forms thereof as come within the scope of the following claims.

What is claimed is:

1. A rack for holding a conventional paper grocery bag and a plastic bag having a pair of integral extending handle loops, in an upright, open, supported position, the rack comprising:

(a) a skeletal frame including
(i) a pair of spaced side members;
(ii) a back member;
(iii) a bottom support member; and
(iv) at least one front member; the members forming a confinement boundary for the bag; and
(b) an engagement rail at a top of each side member, each engagement rail including
(i) two upwardly extending spaced outer arm portions, the two outer arms on each of the two side members being adapted to securely retain one of the plastic bag handle loops so that the two outer arms on both side members support the suspended plastic bag and hold the bag open; and
(ii) a downwardly extending tab disposed substantially between the outer arm portions, the tabs each being free of connecting structure and releasably engageable with an upstanding sidewall of the paper bag so that the tabs on both side members extend downwardly into the paper bag to hold the paper bag sidewalls apart and the bag open.

2. the rack specified in claim 1 wherein the two upwardly extending spaced outer arms and the downwardly extending tab on each engagement rail are formed from the same rod.

3. The rack specified in claim 1 wherein the back member and front members are spaced less the height of the grocery bag to be supported from the bottom support member.

4. The rack specified in claim 1 wherein two front members and the bottom support member define an upwardly opening channel between the front members which allows a user's hand to continually lift and support the bottom of a bag without obstruction by the skeletal frame as the bag is lifted from the rack and placed outside the rack, and also allows a back member or a front member of an identical rack to extend the full length of the channel in inverted relation to permit one rack to be nested within two other identical racks placed in adjacent relation to each other.

5. A rack for holding conventional paper grocery bags, and plastic bags having a pair of integral extending handle loops, in an upright, open, supported position, the rack comprising:
(a) a skeletal frame including
(i) a pair of spaced side members;
(ii) a back member;
(iii) a bottom support member; and
(iv) at least one front member; the members forming a confinement boundary for the bag;
(b) an engagement rail at a top of each side member, each engagement rail including
(i) two upwardly extending spaced outer arm portions, the two outer arms on each of the two side members being adapted to securely retain one of the plastic bag handle loops so that the two outer arms on both side members support the suspended plastic bag and hold the bag open; and
(ii) a downwardly extending tab disposed substantially between the outer arm portions, the tabs being releasably engageable with a foldable upstanding sidewall of the paper bag so that the tabs on both side members hold the paper bag sidewalls apart and the bag open; and
(c) an unused bag holder adjoining the back member of the frame, the unused bag holder including two opposing members each defining a centrally disposed opening to receive unused folded bags therein.

6. The rack specified in claim 5 wherein both opposing members have ends which are perpendicular to the back member of the frame, and a side which is spaced from and parallel to the back member of the frame, and wherein the opposing members converge in a downward direction.

7. The rack specified in claim 5 wherein two front members and the bottom support member define an upwardly opening channel between the front member which allows a user's hand to continuously lift and support the bottom of a bag without obstruction by the skeletal frame as the bag is lifted from the rack and placed outside the rack, and also allows a back member or a front member of an identical rack to extend the full length of the channel in inverted relation to permit one rack to be nested within two other identical racks placed in adjacent relation to each other.

8. The rack specified in claim 1 wherein the skeletal frame includes a plurality of horizontal and vertical rod portions which form the side members, back member, bottom support members and front members.

9. The rack specified in claim 1 wherein there are two spaced front members, each of which adjoins and is substantially perpendicular to a side member.

10. A rack for holding conventional paper grocery bags, and plastic bags with extending handle loops, in an upright, open supported position, the rack comprising:
(a) a skeletal frame which forms a bag confinement and includes
(i) a pair of spaced mirror-image side members;
(ii) a back member;
(iii) a bottom support member; and
(iv) two front members, each front member adjoining and perpendicular to a side member, wherein the two front members and the bottom support member define an upwardly opening channel between the front members which allows a user's hand to lift and support the bottom of a bag without obstruction by the skeletal frame as the bag is lifted from the rack and placed outside the rack, and also allows a back member or a front member of an identical rack to extend the full length of the channel in inverted relation to permit one rack to be nested within two other identical racks placed in adjacent relation to each other; and
(b) means at a top of the rack for engaging paper grocery bags and the handles of plastic bags to maintain them in a supported open configuration within the bag confinement boundary.

11. The rack specified in claim 10 wherein the back member and front members are spaced less than the height of a conventional grocery bag to be supported from the bottom support member.

12. A rack for holding conventional paper grocery bags, and plastic bags with extending handle loops, in an upright, open supported position, the rack comprising:
(a) a skeletal frame which forms a bag confinement and includes
(i) a pair of spaced mirror-image side members;
(ii) a back member;
(iii) a bottom support member; and
(iv) two front members, each front member adjoining and perpendicular to a side member, wherein the two front members and the bottom support member define an upwardly opening channel between the front members which allows a user's hand to lift and support the bottom of a bag without obstruction by the skeletal frame as the bag is lifted from the rack and placed outside the rack, and also allows a back member or a front member of an identical rack to extend the full length of the channel in inverted relation to permit one rack to be nested within two other identical racks placed in adjacent relation to each other;

(b) means at a top of the rack for engaging paper grocery bags and the handles of plastic bags to maintain them in a supported open configuratin within the bag confinement boundary; and (c) an usused bag holder adjoining the back member of the frame, the unused bag holder including two opposing members each having a centrally disposed opening to receive unused folded bags therein and ends for supporting the folded bags therein.

13. The rack specified in claim 12 wherein both members have ends which are perpendicular to the back member of the frame, and sides which are spaced from and parallel to the back member of the frame, and wherein the sides converge in a downward direction.

14. The rack specified in claim 10 wherein the skeletal frame includes a plurality of horizontal and vertical rod portions which form the side members, back member, bottom support members and front members.

15. A rack for holding conventional paper grocery bags, and plastic bags with extending handle loops, in an upright, open, supported position, the rack comprising:

(a) a skeletal frame including (i) a pair of spaced side members;

(ii) a back member;

(iii) a bottom support member; and (iv) at least one front member; the members forming a bag confinement boundary;

(b) means at a top of the rack for engaging paper grocery bags and the handles of plastic bags to maintain them in a supported open configuration within the bag confinement boundary; and (c) an unused bag holder adjoining the back member of the frame, the unused bag holder including two opposing members each spaced from the back member of the frame and cooperating therewith to define a centrally disposed opening to receive unused folded bags therein and having ends extending to the back member of the frame for supporting the bags therein.

16. The rack specified in claim 15 wherein both the ends of the opposing members are perpendicular to the back member of the frame, and the sides of the opposing members are parallel to the back member of the frame and converge in a downward direction.

17. The rack specified in claim 15 wherein the back member and front members are less than seventeen inches in height from the bottom support member.

18. The rack specified in claim 15 wherein the skeletal frame includes a plurality of horizontal and vertical rod portions which form the side members, back member, bottom support members and front members.

19. The rack for holding paper grocery bags and plastic bags specified in claim 15 wherein the two side members are mirror-images and wherein there are two front members, each of which adjoins and is substantially perpendicular to a side member.

* * * * *